US005702852A

United States Patent [19]

May et al.

[11] Patent Number: 5,702,852

[45] Date of Patent: Dec. 30, 1997

[54] MULTI-COLOR METHOD OF TONER TRANSFER USING NON-MARKING TONER AND HIGH PIGMENT MARKING TONER

[75] Inventors: John W. May, Rochester; Thomas N. Tombs, Brockport; Dinesh Tyagi, Fairport, all of N.Y.

[73] Assignee: Eastman Kodak Company, Rochester, N.Y.

[21] Appl. No.: 572,360

[22] Filed: Dec. 14, 1995

Related U.S. Application Data

[60] Provisional application No. 60/003,013, Aug. 31, 1995, and provisional application No. 60/003,014, Aug. 31, 1995.

[51] Int. Cl.[6] ..... G03G 13/01

[52] U.S. Cl. ..... 430/47; 430/45; 430/110; 430/111; 430/126

[58] Field of Search ..... 430/47, 45, 126, 430/110, 111

[56] References Cited

U.S. PATENT DOCUMENTS

| | | | |
|---|---|---|---|
| 2,807,233 | 9/1957 | Fitch | 118/637 |
| 3,520,604 | 7/1970 | Shelffo | 355/16 |
| 3,702,482 | 11/1972 | Dolcimascolo et al. | 346/74 |
| 3,781,105 | 12/1973 | Meagher | 355/3 |
| 3,813,267 | 5/1974 | Honjo et al. | 156/236 |
| 3,901,698 | 8/1975 | Fukushima et al. | 96/1 R |
| 3,959,574 | 5/1976 | Seanor et al. | 48/425 |
| 4,040,828 | 8/1977 | Evans | 96/1.2 |
| 4,064,285 | 12/1977 | Mammino | 427/24 |
| 4,066,802 | 1/1978 | Clemens | 427/24 |
| 4,078,929 | 3/1978 | Gundlach | 96/1.2 |
| 4,175,958 | 11/1979 | Naganuma et al. | 430/49 |
| 4,216,283 | 8/1980 | Cooper et al. | 430/110 |
| 4,294,902 | 10/1981 | Takashima et al. | 430/45 |
| 4,367,276 | 1/1983 | Cooper et al. | 430/126 |
| 4,368,250 | 1/1983 | Cooper et al. | 430/109 |

(List continued on next page.)

FOREIGN PATENT DOCUMENTS

| | | |
|---|---|---|
| 91586/82 | 6/1983 | Australia . |
| 91450/82 | 7/1983 | Australia . |
| 989683 | 5/1976 | Canada . |
| 554981 | 8/1993 | European Pat. Off. . |
| 0 629 921 A | 12/1994 | European Pat. Off. . |
| 638849 | 2/1995 | European Pat. Off. . |
| 3148505 | 6/1983 | Germany . |
| 59-25215 | 6/1984 | Japan . |
| 63-256967 | 10/1988 | Japan . |
| 1-1334485 | 5/1989 | Japan . |
| 1-237561 | 9/1989 | Japan . |
| 2-120765 | 5/1990 | Japan . |
| 7-6211 | 2/1995 | Japan . |
| 2 166 881 | 5/1986 | United Kingdom . |

*Primary Examiner*—Mark Chapman
*Attorney, Agent, or Firm*—Doreen M. Wells

[57] ABSTRACT

This invention provides a method and apparatus which forms a desired toner image on a receiver by:

forming at least one electrostatic image on at least one imaging member;

toning at least one said electrostatic image with marking toner particles of at least one color;

transferring said marking toner particles from at least one said imaging member to the surface of an intermediate transfer member in the presence of an electric field which urges said marking toner particles toward said intermediate transfer member; and transferring said marking toner particles from said intermediate transfer member to a receiver in the presence of an electric field which urges said marking toner particles toward said receiver;

wherein, when transferring said marking toner particles to said intermediate transfer member from at least one said imaging member, said surface of said intermediate transfer member contacts non-marking toner particles in areas which receive marking toner, and wherein said marking toner particles have a volume weighted diameter of 2 to 8 μm and comprise pigment at a concentration of from 10 to 50% by weight of the total toner composition.

21 Claims, 1 Drawing Sheet

U.S. PATENT DOCUMENTS 4,370,400 1/1983 Cooper et al. ..... 430/126
4,464,453 8/1984 Cooper et al. ..... 430/126
4,562,129 12/1985 Tanaka et al. ..... 430/42
4,562,130 12/1985 Oka ..... 430/54
4,600,669 7/1986 Ng et al. ..... 430/47
4,686,163 8/1987 Ng et al. ..... 430/47
4,729,925 3/1988 Chen et al. ..... 428/425.8
4,742,941 5/1988 Tastet ..... 222/309
4,828,954 5/1989 Hashimoto et al. ..... 430/110
4,900,647 2/1990 Hikake et al. ..... 430/137
4,921,768 5/1990 Kunugi et al. ..... 430/45
4,927,727 5/1990 Rimai et al. ..... 430/99
4,935,788 6/1990 Fantuzzo et al. ..... 355/326
4,950,573 8/1990 Yamaguchi et al. ..... 430/109
4,986,211 1/1991 Coulter, Jr. et al. ..... 118/644
5,011,739 4/1991 Nielsen et al. ..... 428/425.8
5,021,317 6/1991 Matsubara et al. ..... 430/110
5,021,318 6/1991 Mayo et al. ..... 430/124
5,037,718 8/1991 Light et al. ..... 430/126
5,043,242 8/1991 Light et al. ..... 430/126
5,045,426 9/1991 Maierson et al. ..... 430/126
5,045,888 9/1991 Imaeda ..... 355/282
5,075,186 12/1991 Sheridon ..... 430/47
5,079,115 1/1992 Takashima et al. ..... 430/45
5,084,735 1/1992 Rimai et al. ..... 355/271
5,093,220 3/1992 Masaki et al. ..... 430/109
5,102,767 4/1992 Chowdry et al. ..... 430/126
5,104,765 4/1992 Chowdry et al. ..... 430/126
5,108,865 4/1992 Zwaldo et al. ..... 430/126
5,147,745 9/1992 Russel ..... 430/49
5,156,915 10/1992 Wilson et al. ..... 428/425.8
5,176,979 1/1993 Eguchi et al. ..... 430/110
5,178,984 1/1993 Nagatsuka et al. ..... 430/110
5,184,183 2/1993 Karidis et al. ..... 355/266
5,187,526 2/1993 Zaretsky ..... 355/273
5,192,637 3/1993 Saito et al. ..... 430/109
5,194,356 3/1993 Sacripante et al. ..... 430/106.6
5,212,032 5/1993 Wilson et al. ..... 430/65
5,217,838 6/1993 Wilson et al. ..... 430/126
5,233,396 8/1993 Simms et al. ..... 355/275
5,234,783 8/1993 Ng ..... 430/45
5,244,764 9/1993 Uno et al. ..... 430/106
5,250,357 10/1993 Wilson et al. ..... 428/425.8
5,260,753 11/1993 Haneda et al. ..... 355/282
5,278,018 1/1994 Young et al. ..... 430/110
5,308,733 5/1994 Rimai et al. ..... 430/126
5,362,593 11/1994 Inoue et al. ..... 430/111
5,364,720 11/1994 Nakazawa et al. ..... 430/106.6
5,370,961 12/1994 Zaretsky et al. ..... 430/126
5,378,572 1/1995 Akiyama et al. ..... 430/110
5,412,019 5/1995 Roulstone et al. ..... 524/497
5,415,936 5/1995 Deusser et al. ..... 428/405
5,418,103 5/1995 Muto et al. ..... 430/109
5,419,928 5/1995 Deusser et al. ..... 427/384
5,480,757 1/1996 Jadwin et al. ..... 430/110
5,561,510 10/1996 Kamp et al. ..... 355/272

MULTI-COLOR METHOD OF TONER TRANSFER USING NON-MARKING TONER AND HIGH PIGMENT MARKING TONER

REFERENCE TO RELATED APPLICATIONS

Reference is made to and priority claimed from U.S. provisional application 60/003,013 filed Aug. 31, 1995 and 60/003,014 filed Aug. 31, 1995.

FIELD OF THE INVENTION

The present invention relates to electrostatography and more particularly to multi-color methods of using non-marking toner and small particle size marking toner to improve the transfer of toner images to and from intermediate transfer members.

BACKGROUND OF THE INVENTION

In a conventional multi-color electrostatographic copying or printing process, several electrostatic images are formed sequentially on an image member, each electrostatic image representing the cyan, magenta, yellow and black color separations of a desired final toner image. These electrostatic images are toned with charged toner particles containing appropriate colorants to produce toned electrostatic images. These toned electrostatic images may be sequentially transferred to an intermediate transfer member on top of each other in registration to create a multi-color toner image. From the intermediate transfer member (ITM) the multi-color toner image is transferred to a receiver and then the multi-color toner image is fixed to the receiver by a suitable method, such as by pressurized contact with a heated fuser roller.

To produce high quality pictorial images using electrophotographic methods requires very high transfer efficiency of small toner particles from the imaging member to the ITM and from the ITM to the final receiver, e.g., paper. For multi-color toner images, especially portions of such images containing high-spatial-frequency image information, complete toner transfer from the imaging member to ITM, and from the ITM to the final receiver is difficult to achieve for several reaons One reason transfer is difficult to achieve is due to the composition of conventional toners.

Conventional toners typically consist of finely divided pigment particles dispersed in a polymeric binder. The pigment concentration must be sufficiently low to allow proper fusing to the final receiver, because generally the melt viscosity of toners increases sharply as pigment concentration is increased. Because the pigment concentrations are low in conventional toners, high-density color areas (D-max) require thick toner laydowns which can consist of multilayer laydowns of each color toner. High density laydowns of toner containing two or more D-max colors will, therefore, have much thicker stack heights than submonolayer, low density laydowns of toner. When high- and low-density regions are adjacent, or when there are high-spatial-frequency components with large variations in density, the adjacent stack height differences can be so great that transfer of the low density areas is degraded near the stack height boundaries. In cases of direct transfer to the final receiver, or indirect transfer using a non-compliant ITM, large stack height differences can produce the related image defect known as "halo", caused when low density toner immediately adjacent to high density toner does not transfer and is left behind on the imaging member.

It should also be noted that different stack heights of toner in an electrostatic transfer nip produce different electrical responses, giving rise to different electric fields for electrostatic transfer. The transfer of toners having different stack heights is complicated by this condition.

Conventional toners have yet another drawback, namely, the tendency to produce image spread during typical high pressure thermal fusing. Such image spread can result in objectionable dot gain and unwanted hue shifts in half-tone imaging.

Another problem is that conventional toners are formulated so that the binder polymers in the toners have low glass transition temperatures necessary for heat fusing of the toners to a receiver. Because of the low glass transition temperatures of conventional toners, the toners have a tendency to agglomerate into flakes in the development station. The flakes can be developed onto a receiver and degrade image quality.

S. Volkers, European Application 93300364.2 discloses the use of a non-marking toner layer on an ITM. The Application teaches the use of conventional non-marking and marking toners and liquid developers. The use of a non-marking toner layer on the ITM does not address the problems of simultaneously transferring short and tall toner stack heights, halo, toner dot gain and toner flakes.

There is a continuing need for improving the transfer efficiency of toner particles to and from an intermediate transfer member so as to improve the image characteristics of the final toner image. Further, there is a need to reduce the image degradation caused by flaking and dot gain of the marking toners. This need is especially great for high definition color imaging using small color toner particles.

SUMMARY OF THE INVENTION

In accordance with the present invention, there is provided a method and apparatus which form a desired toner image on a receiver by:

- forming at least one electrostatic image on at least one imaging member;
- toning at least one said electrostatic image with marking toner particles of at least one color;
- transferring said marking toner particles from at least one said imaging member to the surface of an intermediate transfer member in the presence of an electric field which urges said marking toner particles toward said intermediate transfer member;
- transferring said marking toner particles from said intermediate transfer member (ITM) to a receiver in the presence of an electric field which urges said marking toner particles toward said receiver;

wherein, when transferring said marking toner particles to said intermediate transfer member from at least one said imaging member, said surface of said intermediate transfer member contacts non-marking toner particles at least in areas which receive marking toner particles, and wherein said marking toner particles have a volume weighted diameter of 2 to 8 μm and comprise pigment at a concentration of from 10 to 50% by weight of the total toner composition.

The advantages of the method of the invention, which provides and uses the presence of non-marking toner on the ITM and small particle size high pigment concentration marking toner, also referred to as high pigment toner, are that the transfer efficiency of the marking toner particles from the imaging member to the ITM is unexpectedly increased, and the transfer efficiency from the ITM to the receiver is also remarkably increased. The transfer efficiency is improved by the presence of the non-marking toner, and by the reduction in the difference in the stack heights when using the high pigment marking toner. The reduced difference in stack heights provides a reduced difference in electrostatic forces which improves toner transfer. The reduced stack heights provide the further advantages that there is improved contact to all toner stacks, and that compliancy characteristics of the ITM can be less stringent than when using conventional toners. Transfer in contact transfer systems is improved by the reduced stack heights, because the air gaps are reduced or eliminated. Improved toner transfer improves image quality and has the additional advantage of reducing the need to clean the imaging member and the ITM. This invention also provides improved image quality, because the small particle size, high pigment, marking toners experience less dot gain, less flaking, higher reflection densities and better covering power as compared to conventional toners. An additional benefit of this invention is that marking toner consumption will decrease.

DESCRIPTION OF THE PREFERRED EMBODIMENTS

Figure 1:
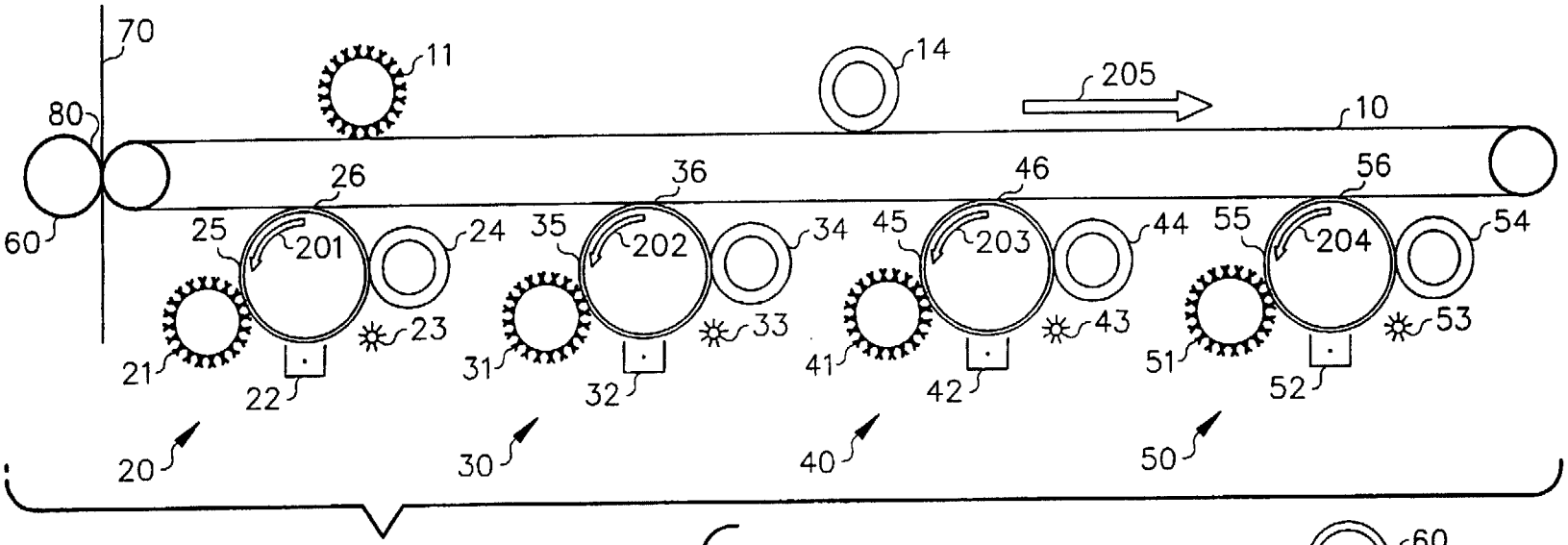
FIG. 1 is a diagrammatical view of an apparatus for carrying out the method of the invention.

The term "imaging member" refers to a member onto which an electrostatic image is formed, such as, photoconductive elements, dielectric elements and electrophotographic masters.

The term "bias development", as used herein, means depositing charged toner particles from a development station biased with a voltage to urge the toner particles to a member, for example, an ITM or imaging member. The member can also be biased with a voltage to urge the toner particles from the development station to the member.

The term "monolayer", as used herein, means a substantially full coverage of toner particles making up a single layer such that the addition of more toner particles forms a second layer of toner.

The terms "toner density" or "transmission density", as used herein, means the optical density as measured on a fused toner image by an optical densitometer using white light in the transmission mode, using, for example an X-rite® Photographic Densitomer model 310. The transmission density of the receiver is nulled or subtracted from these measurements. For opaque receivers, the transmission density measurement should be made on a transparent receiver having an equivalent amount of toner.

The term "particle size", as used herein, or the term "size", or "sized" as employed herein in reference to the term "particles" (unless otherwise indicated), means the mean volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by total particle mass.

The term "glass transition temperature" or Tg as used herein means the temperature at which an amorphous material changes from a solid state to a rubbery state. This temperature can be measured by differential thermal analysis as disclosed in N. F. Mott and E. A. Davis, "Electronic Processes in Non-Crystalline Materials," Oxford Press (1971).

The term "receiver" as used herein refers to a substrate upon which a toner image is transferred and subsequently heat fused or otherwise fixed to produce a final image. Examples of suitable receivers include paper and plastic film such as films of polyethylene terephthalate, polycarbonate, or the like, which are preferably transparent and therefore useful in making transparencies. Paper is a presently preferred class of receiver, particularly smooth papers such as clay-coated or polymer-coated papers.

The term "imagewise" as used herein means corresponding to a desired toner image to be produced. The term "non-imagewise" means not containing any information corresponding to a desired final toner image to be produced. Typically a non-imagewise lay-down of non-marking toner means a substantially uniform flat-field deposit.

The method of this invention can be an electrostatographic method in general, but is preferably a xerographic method, and most preferably a multi-color xerographic method.

The method of this invention can be used when making contone or other image types, such as half-tone images using dots or line screens. For half-tone images using dots or line screens, the expression "areas to receive marking toner particles" or similar expressions having the same meaning, can include subareas within, for example a character or line, which will not receive toner, because of the half-tone system. Most of the description below contemplates the method of this invention using a contone system, but the method as described is easily adapted to a half-tone system by a person of ordinary skill in the art, and is within the scope of this invention.

Figure 2:
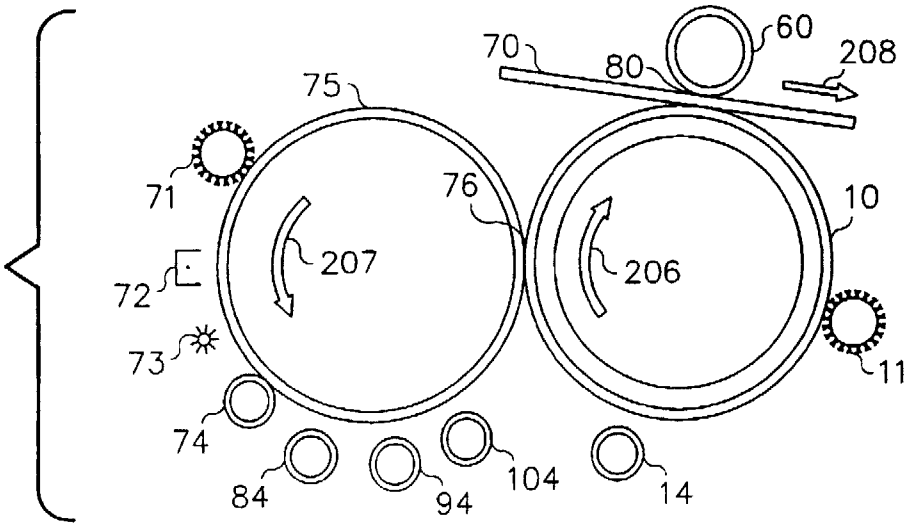
FIG. 2 is a diagrammatical view of an apparatus of the invention for carrying out the method of the invention.

In the method of this invention more than one imaging member, as defined above, can be used. Typically, an apparatus for making single color final toner images has a single imaging member, and an apparatus for making multi-color final toner images has either one or more than one imaging members. To make multi-color toner images, a single imaging member can be used to make each individual electrostatic image for each color separation and then the individual color toner images are transferred from the imaging member to the ITM sequentially and in registration. The method consists of forming one electrostatic image on an imaging member corresponding to one color in the desired toner image; toning by applying the corresponding color marking toner particles to the electrostatic image to form an individual color toner image; and transferring the individual color toner image to the surface of an ITM in the presence of an electric field which urges the individual toner image toward the ITM and repeating the forming, toning and transferring steps for each color separation in a desired toner image. An example of this apparatus is shown in FIG. 2 which is described below.

In another embodiment, a single imaging member is used to make the individual electrostatic images for each color separation of a desired toner image, in registration, on top of each other on the imaging member. In this embodiment to create a multicolor image, at least two electrostatic images are formed and toned, sequentially, in registration on the same frame of the imaging member with marking toners of at least two different colors, and then the layers of the different marking toners are transferred simultaneously to an ITM in the presence of an electric field which urges the marking toner particles toward the ITM. This method is described in Gundlach, U.S. Pat. No. 4,078,929, incorporated herein by reference.

Alternatively, more than one imaging member can be present in an apparatus to simultaneously form electrostatic images for the different color separations of one or more final toner images. An example of this apparatus is shown in FIG. 1 which is described below.

An additional imaging member can be incorporated into an apparatus used in the method of this invention for the application, either imagewise or non-imagewise, of the non-marking toner particles to the ITM.

The apparatus used in the method of this invention can have any known means for establishing imagewise electrostatic charge on the imaging member(s). The most preferred means is to use a corona or roller charger to deposit a uniform electrostatic charge on imaging member(s), preferably photoconductive imaging member(s), and then to expose the photoconductive imaging member(s) to light from one or more exposing devices which reduces some of the charge on the photoconductive imaging member(s) to create an imagewise charge also referred to as an electrostatic image, sometimes referred to as an electrostatic latent image, on the photoconductive imaging member(s).

The apparatus of this invention has at least one development station for marking toner particles, also referred to as a "marking development station". An apparatus having one marking development station produces single color toner final images. An apparatus with multiple marking development stations for different color marking toners can be used to produce single color or multi-color final toner images. It is preferred that each marking development station has the capacity to create a voltage difference between the marking development station and the imaging member so that marking toner particles are urged to transfer from the marking development station and electrostatically adhere to the imaging member to form a toned electrostatic image on the imaging member.

Preferably, the apparatus has a development station for non-marking toner particles, referred to as a "non-marking development station". It is preferred that the non-marking development station has the capacity to create a voltage difference between the non-marking development station and a member so that non-marking toner particles are urged to transfer from the non-marking development station to the member, e.g. imaging member or ITM.

Various techniques for depositing both the marking and the non-marking toners from marking and non-marking development stations, preferably bias development stations, to a member may be used. Examples include contact deposition, such as by using a magnetic brush, or non-contact deposition, such as by projection toning and powder cloud development.

This invention provides that non-marking toner contacts the ITM at least in all the areas to receive marking toner particles. The non-marking toner can be present everywhere in an image frame on the ITM or it can be present only, or at least, in areas in the image frame on the ITM which receive marking toner particles. An image frame on the ITM is an area on the ITM equal to the area of an image frame on the imaging member, i.e. the area in which imaging information including both toner and non-toner areas is present for an image. It is presently preferred that a uniform layer of non-marking toner is present everywhere on an image frame of the ITM; however, non-uniform lay-downs of non-marking toner are contemplated by this invention. For example, it may be desirable to deposit more non-marking toner on the ITM in areas to receive marking toner particles than in areas which will not receive marking toner particles, that is, background areas.

It is preferred that at least a monolayer of non-marking toner particles is present in areas that receive marking toner on the ITM, and it is more preferred that from a monolayer to 4 layers of non-marking toner particles are present in areas to receive the marking toner particles. It is most preferred that the lay-down of non-marking toner is uniform everywhere in an image frame on the ITM.

The non-marking toner can be deposited on the ITM in a variety of ways. For example, the non-marking toner particles can be applied to the ITM from an imaging member or from another member or they can be applied directly to the ITM from a non-marking development station prior to the transfer of the marking toner particles from an imaging member to the ITM. The non-marking toner particles can be applied directly to the ITM from a development station typically non-imagewise by bias development. Alternatively, the non-marking toner particles can be applied imagewise or non-imagewise to an imaging member prior to transferring the non-marking toner to the surface of the ITM. For example, to apply the non-marking toner non-imagewise to an imaging member, non-marking toner can be bias developed uniformly to the whole imaging frame on the imaging member. To apply the non-marking toner imagewise to an imaging member, an electrostatic image can be created by exposing a charged imaging member to an exposing device, i.e., to reflected light off an original on a platen or to light from a computer controlled laser or light emitting diodes (LED). The latter method, using a computer controlled LED or laser, can be used to selectively apply non-marking toner to the ITM in an imagewise, non-imagewise, uniform or non-uniform fashion.

One method of applying the non-marking toner to the ITM, which may be the preferred method when producing images, for example, which have pictorial portions and textual portions in a single image, is to apply the non-marking toner everywhere in a predetermined area (e.g. the pictorial area) of the image frame and in the areas to receive making toner particles in the textual portions of the image frame outside the predetermined area. A single image may have one or more predetermined areas. This method is preferred when producing images which have pictorial portions and textual portions in a single image, because in the final toner image the entire predetermined area will have a uniform gloss even in areas where there is no marking toner present and the textual portions will have non-marking toner present only in areas where the marking toner(s) is (are) present.

For the imagewise application of non-marking and marking toner to the ITM, the image information of a desired toner image may be analyzed. For example, an original image can be scanned by an input digital scanner or the original image information can be generated by a digital computer and the image information stored in a buffer or other memory. A digital computer can be part of the apparatus of this invention to utilize input of the image information from the buffer to establish and provide appropriate bit maps to one or more drivers, for example, LED or laser drivers which control the exposing device, for example, a laser or LED. The controller provides to the drivers one bit map for the non-marking toner image and a bit map for each of the color separations making up a final toner image. The electrostatic images for the non-marking toner and for each color in a final image can be formed sequentially or simultaneously on one or more imaging members, toned with the appropriate and corresponding color or non-marking toner, transferred to the ITM either sequentially or simultaneously, and then simultaneously transferred from the ITM to the receiver. The forming, toning and transferring steps can occur by the methods described above.

The computer can be programmed to formulate the bit map for the non-marking toner by analyzing the image information and exposing or not exposing the imaging member to be toned with non-marking toner based on the image information. The computer can be programmed to form an electrostatic image for toning with non-marking toner for example, only in areas that correspond to the presence of marking toners, or at one amount in the background areas and a second amount in areas that correspond to the presence of marking toners, or everywhere in a predetermined image area and in all areas which receive marking toners outside of the predetermined image area. The non-marking toner is then transferred from the imaging member to the ITM prior to the transfer of marking toners to the ITM.

For example, in an embodiment where separate color toner images are transferred from the imaging member to the ITM in series, and three layers of non-marking toner are applied to the ITM in areas to receive marking toner and a monolayer of non-marking toner is applied to the ITM in all other areas on the ITM, each color separation is analyzed to determine where the marking toner is present, and the computer generates a bit map for the non-marking toner which is used as described above to expose an imaging member, develop and transfer non-marking toner to the ITM. The bit map will be established to expose an imaging member so that an amount of non-marking toner proportional to the total anticipated thickness of color toner will be deposited on the imaging member corresponding to the areas on an image frame of the ITM where marking toner will be transferred to the ITM, and a monolayer of non-marking toner will be deposited everywhere else on the image frame of the imaging member.

In other embodiments, the non-marking toner can be applied imagewise to the ITM or on top of the marking toner on the imaging member to give a substantially uniform thickness in all areas during transfer of marking toner to the ITM. This process is referred to as stack height leveling. As a result, the total thickness of the marking and non-marking toner on the ITM is substantially uniform or approaches uniform thickness in all areas upon transfer of the marking and non-marking toner from the ITM to the receiver. These embodiments can be accomplished following computer analysis of the color information of a final toner image.

In other embodiments, the non-marking toner particles are transferred from an imaging member at the same time as the transfer of at least a first color of marking toner particles from an imaging member to the ITM. In one such embodiment, non-marking toner is bias developed on top of the marking toner image while it resides on the imaging member, followed by subsequent transfer of both non-marking and marking toner. To accomplish this, the image frame containing the marking toner image on the imaging member can be recharged and optionally selectively exposed so that, following development with non-marking toner, the non-marking toner forms a non-imagewise or imagewise deposit. The marking toner and the non-marking toner are then simultaneously transferred to the ITM. Alternatively, non-marking toner can be applied over at least one marking toner image on the imaging member(s) and then each non-marking toner/marking toner bilayer can be transferred simultaneously from the imaging member(s) to the ITM. For the application of non-marking toner to the imaging member prior to the application of marking toner, a first electrostatic image can be formed and toned with non-marking toner on an imaging member, either imagewise or non-imagewise, then a second electrostatic image can be formed over the non-marking toner particles on the imaging member and the second electrostatic image can be toned by applying the marking toner particles to the second electrostatic image. The layer of non-marking toner on the imaging member will provide for improved transfer of the high pigment marking toner from the imaging member.

In another embodiment of the invention, sandwiches of non-marking toner/marking toner/non-marking toner etc. are formed on the ITM. To form the sandwiches, non-marking toner particles can be applied to the ITM directly from a non-marking development station or imaging member before and after the transfer of each color marking toner image from the imaging member(s).

The preferred method for depositing non-marking toner particles onto the ITM may depend on the characteristics of the receiver and the image. For a glossy receiver or a pictorial document, the preferred method is to directly apply the non-marking toner particles to the image frame on the ITM uniformly, non-imagewise from a separate development station prior to the transfer of any marking toner particles from any imaging member to the ITM. For non-glossy paper receivers or non-pictorial document, the preferred method is to transfer the non-marking toner particles to the ITM imagewise from an imaging member corresponding to areas that receive marking toner prior to the transfer of the first marking toner image from any imaging member to the ITM. For images having both pictorial portions and textual portions, it is preferred to apply non-marking toner uniformly in predetermined areas (i.e. the pictorial portions) and only where marking toner is present in the textural portions.

In another embodiment of the invention, in addition to applying non-marking toner to the ITM at least or only in areas to receive marking toner, non-marking toner can be applied to the receiver prior to the transfer of the marking toner (and non-marking toner) from the ITM to the receiver. The non-marking toner on the receiver increases the transfer efficiency of the marking toner from the ITM to the receiver and provides additional toner binder which improves the fusing of the marking toner particles to the receiver. The non-marking toner, typically one to form layers of toner, can be applied to the receiver imagewise or non-imagewise from an imaging member or other member or non-imagewise from a non-marking toner development station. The methods described above for the application of non-marking toner to the ITM are adaptable to the application of non-marking toner to the receiver.

In still other embodiments of the invention, an overlay of non-marking toner can be transferred to the receiver after the transfer of the marking toner (and non-marking toner) from the ITM to the receiver. The overlay of non-marking toner on the receiver provides additional toner binder which improves the fusing of the marking toner to the receiver. It may be necessary to overlay non-marking toner on top of the high pigment marking toner on the receiver, because for some of the high pigment marking toners useful in the method and apparatus of this invention, the concentration of the binder polymer in the high pigment marking toner composition is too low to sufficiently adhere the marking toner to the receiver using conventional heat and contact fusing systems. Between one and four layers of additional non-marking toner should provide the additional toner binder necessary for good adhesion of the high pigment marking toner to the receiver. The non-marking toner can be applied imagewise from an imaging member or non-imagewise from a non-marking toner development station using the methods described above. The non-marking toner that is used for the overlay can consist of larger non-marking toner particles than is preferred for the non-marking toner that contacts the ITM in areas to receive marking toner particles. For example, non-marking toner particles from 2 to 20 μm can be used for the overlay.

FIG. 1 shows a parallel intermediate transfer apparatus used in the method of the invention. The parallel transfer apparatus has four imaging modules 20, 30, 40, 50, an intermediate transfer member 10 and backup roller 60. Each module consists of an imaging member 25, 35, 45, 55; development station 24, 34, 44, 54; charger 22, 32, 42, 52; cleaner 21, 31, 41, 51; exposing device 23, 33, 43, 53 and transfer nip 56, 46, 36 and 26. Each of the imaging members 25, 35, 45, 55 is in transfer relationship with ITM 10. The ITM 10 has a cleaner 11, and a development station 14 for non-marking toner in transfer relation with the ITM. Referring to FIG. 1, in the method of this invention, non-marking toner is transferred from development station 14 by a transfer voltage applied between the ITM 10 and the development station 14. The non-marking toner is applied uniformly to an imaging frame on the surface of the ITM 10 as the ITM moves past development station 14 in the direction indicated by arrow 205. The imaging modules in series create the yellow, magenta, cyan, and black portions for a single desired final toner image, and the modules can simultaneously create the yellow, magenta, cyan, and black portions of up to four desired final toner images. In this method, imaging member 55 rotates in the direction indicated by arrow 204 past common electrophotographic imaging stations. In order, imaging member 55 is cleaned by cleaner 51, charged by charger 52 to create a uniform electrostatic charge on imaging member 55, exposed by exposing device 53 to create an electrostatic image corresponding to the yellow portion of a first desired final toner image, the electrostatic image is toned at development station with high pigment yellow toner particles 54 to form a toned electrostatic image for all the yellow portions of a final desired toner image and the yellow toned electrostatic image is transferred to the ITM 10 over the non-marking toner at transfer nip 56. At the same time as the yellow toner image is created and transferred to the ITM, non-marking toner is applied from development station 14 to a second frame on ITM 10. Next, the process of creating a toned electrostatic image is repeated in module 40 for the magenta portion of the first final toner image, and the ITM 10 moves into transfer position with imaging member 45 so that the magenta toner image is transferred in registration over the yellow toner image. At the same time that module 40 creates and transfers the magenta portion of the first final toner image to the ITM, module 50 creates and transfers the yellow portion of a second final toner image to the second frame on the ITM 10 over the non-marking toner. Next, module 30 creates the cyan portion of the first final toner image and it is transferred to the ITM 10 over and in registration with the magenta toner image and the yellow toner image. At the same time, module 40 creates and transfers the magenta portion of the second final toner image and transfers it to the ITM over and in registration with the yellow portion of the second final toner image, and module 50 creates the yellow portion of a third final toner image and transfers it to a third frame on the ITM 10 over non-marking toner. This pattern is repeated for all the final toner images to be made. Prior to the transfer of any yellow toner images from imaging member 55 to the ITM, non-marking toner is applied to the ITM from development station 14. After the black toner image from module 20 is transferred to the ITM 10 from imaging member 25 in registration with the cyan, magenta, and yellow toner images of a final toner image, receiver 70 is fed into the transfer nip 80 formed between the backup roller 60 and the ITM 10. The multicolor toner image consisting of all the color toner images in registration on the ITM 10 is transferred to the receiver 70 urged by a transfer voltage formed between the ITM 10 and the backup roller 60. The multicolor image on the receiver is then usually fused in a contact, heated fuser system (not shown).

FIG. 2 shows a second image-forming apparatus which is useful for carrying out the method of the invention. The apparatus consists of an imaging member 75, an ITM 10 and a backup roller 60. Around the imaging member 75 is a cleaner 71, charger 72, exposing device 73, the ITM 10 and development stations 74, 84, 94 and 104 which can be moved into and out of position for toning the imaging member 75. A transfer nip 76 is formed where imaging member 75 contacts the ITM 10. Development stations 74, 84, 94, and 104 each contain different high pigment color toners, e.g. yellow, magenta, cyan, and black. Intermediate transfer member 10 has a cleaner 11 and a development station 14 for non-marking toner in transfer relationship with the intermediate transfer member. The backup roller 60 can be moved into and out of contact with the ITM 10.

According to FIG. 2, in the method of this invention ITM 10 rotates in the direction indicated by arrow 206 past cleaner 11 and past development station 14 where an imaging frame on the ITM 10 is toned with a non-marking toner from development station 14. At the same time, the imaging member 75 rotates in the direction indicated by arrow 207 past common electrophotographic stations. In order, imaging member 75 is cleaned by cleaner 71, and charged by a charger 72 which uniformly charges the image surface of imaging member 75. The uniformly charged image surface is imagewise exposed by an exposing device 73 to create an electrostatic image on imaging member 75, which corresponds to a single color separation. The electrostatic image on the imaging member 10 is toned when one toner station containing the high pigment color toner corresponding to the color separation formed on the imaging member 75 moves into position for toning the electrostatic image, creating a first single color toned electrostatic image, also referred to as a first color toner image. Development station 74 is shown in position for toning the electrostatic image. The first single color toned electrostatic image is then transferred from imaging member 75 to the ITM 10 over the non-marking toner on the ITM 10. The transfer from the imaging member 75 to the ITM 10 occurs in the transfer nip 76 created where the imaging member 75 contacts the ITM 10. Then, the imaging member is cleaned by cleaner 71, charged by charger 72, and exposed by exposing device 73 to create an electrostatic image for a second color separation on the imaging member 10 and toned when a second toner station is moved into position for toning the electrostatic image on the imaging member 75. The second single color toned electrostatic image on the image member 75 is then transferred in the transfer nip 76 over and in registration with the first color toner image on the ITM 10. These steps are repeated for the other color separations in an image. There are four color separations, typically yellow, magenta, cyan, and black with the development stations 74, 84, 94 and 104 containing these high pigment color toners. After the four color toner images have been transferred sequentially in registration to the ITM 10, a receiver 70 is fed in the direction indicated by arrow 208 into the nip 80 formed between the ITM 10 and the backup roller 60 and the high pigment color toners are simultaneously transferred to the receiver. Usually the toner on the receiver is then fused in a heated, contact fuser system (not shown).

The intermediate transfer member used in the method of this invention can be a drum, web or endless belt. Typically intermediate transfer members consist of a metal support onto which a polymer having a resistivity greater than $10^6$ Ohms-cm, preferably between $10^7$ and $10^{11}$ ohms-cm, is coated. Useful elastomers include polyethyleneterepthalate, fluorinated copolymers, silicone rubbers, butadiene, polyurethanes, polyimides and others. Useful materials for incorporation into the polymers, particularly to affect the resistivity include carbon and antistats, such as, quaternary ammonium compounds, halide salts, and other salts. Intermediate transfer members useful in the method of this invention are disclosed in U.S. Pat. Nos. 2,807,233; 3,520,604; 3,702,482; 3,781,105; 3,702,482; 3,781,105; 3,959,574; 4,729,925; 4,742,941; 5,011,739; 5,212,032; 5,156,915; 9,217,838; and 5,250,357; incorporated herein by reference.

It is preferred that the intermediate transfer member is a drum, also referred to as a roller. It is also preferred that the drum has an electrically conductive metallic core onto which is coated a layer of an elastomeric material having a Young's modulus $10^8$ Newtons/$m^2$ or less, more preferably between about $10^6$ and $5\times10^7$ Newtons/$m^2$, most preferably between $2\times10^6$ and $10^7$ Newtons/$m^2$. The Young's modulus can be measured using an Instron Tensile Tester®. This elastomeric layer will be referred to herein as the "blanket" or "blanket layer". The blanket is preferably between about 0.5 mm and 10 mm thick and preferably has an electrical resistivity between about $10^7$ and $10^{11}$ Ohm-cm, which can be achieved by adding conductivity enhancing material, such as an antistat, to the elastomeric material. Suitable elastomeric materials are polyurethanes, silicones, and fluorinated polyethers. The preferred materials are polyurethanes having suitable addenda to achieve the desired properties. Particularly preferred materials for the ITM are described in U.S. Pat. Nos. 5,212,032; 5,156,915; 5,217,838; and 5,250,357, incorporated herein by reference.

The ITM preferably has an overcoat layer on the blanket. This overcoat preferably is not as thick as the blanket. The overcoat layer preferably consists of a material having a Young's modulus greater than $10^8$ Newtons/$m^2$. The overcoat layer preferably has a thickness of 50 μm or less, more preferably between 0.01 to 15 μm. It is preferred that the resistivity of the overcoat material is greater than $10^6$ Ohm-cm. With the exception that the materials may have a different electrical conductivity and a higher Young's modulus, the chemical nature of the materials useful for the overcoat layer can be similar to (from the same chemical families) those useful for the blanket layer. Examples of suitable materials for the overcoat layer are listed above for the blanket layer. Other suitable materials include diamond-like carbon, ceramers, and polyimides. The currently preferred overcoat material is polyurethane.

The preferred ITM is further described by Tombs et al, APPARATUS AND METHOD OF TONER TRANSFER USING NON-MARKING TONER, U.S. provisional application Ser. No. 60/003,015, filed on Aug. 31, 1995, and incorporated herein by reference.

Although it is not necessary that all the non-marking toner transfer from the ITM to the receiver, it is preferred to transfer the majority, if not all, the non-marking toner from the ITM to the receiver.

The transfer of toner from the ITM to the receiver can be done by any known method including corona transfer or roller transfer. It is preferred in all the embodiments of the invention that a receiver is passed between a nip formed by a backup roller and the ITM to transfer the toner from the ITM to the receiver. The preferred backup roller consists of a metal core having an electrically biased polymer coating having a resistivity of $10^7$ to $10^{12}$ Ohms-cm. A preferred backup roller is disclosed in Zaretsky et al, U.S. Pat. No. 5,187,526, incorporated herein by reference. Typically after the toner particles have been transferred to the receiver, the toner particles are fused to the receiver by a heat and pressurized contact fuser system, preferably consisting of a heated fuser roller and pressure roller. Fuser systems are well known to a person of ordinary skill in the art.

The "non-marking toner", collectively referred to as "non-marking toner particles" is a dry toner composition including a thermoplastic binder polymer, and optionally includes charge control agent, release additives, pigments or dyes and transfer assisting addenda. It is preferred that the non-marking toner particles utilized to improve transfer are approximately equal in size to the marking toner particles. Approximately equal in size means plus or minus 20%. The preferred non-marking toner has a volume weighted diameter between 2 to 10 μm; however useful non-marking toner particles are applied as an overlay over the marking toner on the receiver can have a particle size up to 20 μm.

The non-marking toner particles preferably utilize a thermoplastic binder polymer which is substantially transparent to visible light when fused. Such particles preferably contain substantially no colorant (i.e., a dye or pigment). However, if desired, a small amount colorant may be incorporated into the non-marking toner particles. One reason, for example, that it may be desirable to add colorant to the non-marking toner is to change the color balance of a final toner image or to reduce sensitivity to illumination, e.g. fading.

The "marking toner", collectively referred to as "marking toner particles" employed in the practice of the invention is a dry toner composition having a high concentration of pigment in addition to the thermoplastic binder polymer and the other optional toner components described above for the non-marking toner. Pigment is also referred to herein as dye and colorant. The pigment concentration is from 10 to 50% by weight of the total toner composition, more preferably from 20 and 40% by weight of the total toner composition. Preferably, the marking toner has a particle size from 2 to 8 μm, and more preferably from 3 μm and 6 μm.

The charge per mass (Q/m) for the marking and non-marking toners is preferably between 20 and 300 μC/g. To compensate for the high pigment concentration in the marking toner, it is preferred that the marking toner has a higher charge per mass than the non-marking toner.

Useful binder polymers for the non-marking and marking toners include vinyl polymers, such as homopolymers and copolymers of styrene and condensation polymers such as polyesters and copolyesters. Particularly useful binder polymers are styrene polymers of from 40 to 100 percent by weight of styrene or styrene homologs and from 0 to 45 percent by weight of one or more lower alkyl acrylates or methacrylates. Fusible styrene-acrylic copolymers which are covalently lightly crosslinked with a divinyl compound such as divinylbenzene, as disclosed in U.S. Reissue Pat. No. 31,072, are particularly useful. Also especially useful are polyesters of aromatic dicarboxylic acids with one or more aliphatic diols, such as polyesters of isophthalic or terephthalic acid with diols such as ethylene glycol, cyclohexane dimethanol and bisphenols.

Another useful binder polymer composition comprises:

a) a copolymer of a vinyl aromatic monomer; a second monomer selected from the group consisting of conjugated diene monomers or acrylate monomers selected from the group consisting of alkyl acrylate monomers and alkyl methacrylate monomers; and a third monomer which is a crosslinking agent; and b) the acid form of an amino acid soap which is the salt of an alkyl sarcosine having an alkyl group which contains from about 10 to about 20 carbon atoms. Binder polymer compositions of this type are described in U.S. provisional application Ser. No. 60/001,632, filed Jul. 28, 1995 (now U.S. application Ser. No. 08/657,473, filed May 29, 1996), TONER COMPOSITIONS INCLUDING CROSSLINKED POLYMER BINDERS by Tyagi and Hadcock. Binders of this type are made in accordance with the process described in U.S. Pat. No. 5,247,034 except that the copolymer includes a crosslinking agent.

These thermoplastic binder polymers preferably have glass transition temperatures (Tg) in the range of about 40° C. to about 80° C., although thermoplastic polymers which have somewhat higher and lower Tg can be employed, if desired. This range of Tg is typical for toners that are heat and contact fused to the receiver when a toner bearing receiver is passed through a nip formed by a fuser roller and pressure roller. In the case where semi-crystalline binders are employed, the melting temperature (Tm) can range from about 50° C. to about 140° C. Any binder can be used in the marking and non-marking toners; however, it is preferred that the binders of the marking and non-marking toners are compatible so that they will flow together when the toners are fused. Compatability between the binders for the marking and non-marking toners can be easily accomplished by using the same binder in the marking and non-marking toner compositions.

Another component of the non-marking and marking toner composition is an optional charge control agent. The term "charge control" refers to a propensity of a toner addendum to modify the triboelectric charging properties of the resulting toner. A very wide variety of charge control agents for positive charging toners are available. A smaller number of charge control agents for negative charging toners is also available. Suitable charge control agents are disclosed, for example, in U.S. Pat. Nos. 3,893,935; 4,079,014; 4,323,634; 4,394,430 and British Patent Nos. 1,501,065; and 1,420,839. Charge control agents are generally employed in small quantities such as, from about 0.1 to about 5 weight percent based upon the weight of the toner. Additional charge control agents which are useful are described in U.S. Pat. Nos. 4,624,907; 4,814,250; 4,840,864; 4,834,920; 4,683,188 and 4,780,553. Mixtures of charge control agents can also be used.

A component of the marking toner and an optional component of the non-marking toner is pigment. Suitable pigments are known to a person of ordinary skill in the art and are disclosed, for example, in U.S. Reissue Pat. No. 31,072 and in U.S. Pat. Nos. 4,160,644; 4,416,965; 4,414,152; and 2,229,513 incorporated herein by reference. One particularly useful pigment for marking toner to be used in black and white electrostatographic copying machines and printers is carbon black. Particularly useful colors for multicolor images includes cyan, magenta and yellow for the marking toners. Mixtures of pigments can also be used.

A preferred component in the non-marking toner and an optional component for the marking toner is an additive to improve the abrasion resistance of the multi-color image, such as, an aliphatic amide or aliphatic acid. Suitable aliphatic amides and aliphatic acids are described, for example, in "Practical Organic Chemistry", Arthur I. Vogel, 3rd Ed. John Wiley and Sons, Inc. N.Y. (1962); and "Thermoplastic Additives: Theory and Practice" John T. Lutz Jr. Ed., Marcel Dekker, Inc, N.Y. (1989). Particularly useful aliphatic amide or aliphatic acids have from 8 to about 24 carbon atoms in the aliphatic chain. Examples of useful aliphatic amides and aliphatic acids include oleamide, eucamide, stearamide, behenamide, ethylene bis(oleamide), ethylene bis(stearamide), ethylene bis(behenamide) and long chain acids including stearic, lauric, montanic, behenic, oleic and tall oil acids. Particularly preferred aliphatic amides and acids include stearamide, erucamide, ethylene bis-stearamide and stearic acid. The aliphatic amide or aliphatic acid is present in an amount from about 5 to 30 percent by weight, preferably from about 5 to 8 percent by weight. Mixtures of aliphatic amides and aliphatic acids can also be used. One useful stearamide is commercially available from Witco Corporation as Kemamide® S. A useful stearic acid is available from Witco Corporation as Hysterene® 9718. Marking toner compositions and the preferred non-marking toner compositions are disclosed by Tyagi et al; MONODISPERSE SPHERICAL TONER PARTICLES CONTAINING ALIPHATIC AMIDES OR ALIPHATIC ACIDS; U.S. Ser. No. 60/003,081, filed Aug. 31, 1995 (now U.S. application Ser. No. 08/672,172, filed Jun. 25, 1996), and incorporated herein by reference.

The marking and non-marking toners can also contain other additives of the type used in previous toners, including magnetic pigments, leveling agents, surfactants, stabilizers, and the like. The total quantity of such additives can vary. A present preference is to employ not more than about 10 weight percent of such additives on a total toner powder composition weight basis.

Toners can optionally incorporate a small quantity of low surface energy material, as described in U.S. Pat. Nos. 4,517,272 and 4,758,491.

The marking toner preferably have submicrometer particles appended to the surface of the marking toner particles so as to facilitate transfer. These submicrometer particles will be referred to as "transfer assisting particles" or "transfer assisting addenda." The transfer assisting particles typically have a number average diameter less than 0.4 μm. It is preferred that the transfer assisting particles are between about 0.01 and 0.2 μm, and it is most preferred that the transfer assisting particles are between about 0.05 and 0.1 μm (number average diameter). Preferred addenda are inorganic particles; however, organic particles can also be used. The addenda can assist transfer, as well as be present on the toner for other purposes, such as to affect the charging characteristics of the toner or to make cleaning of the imaging element easier. Methods of making these toners include dry blending the transfer assisting particles with the toner particles as disclosed in G.B. 2,166,881-A; and Japanese Kokai Nos. 63256967, and 01237561. The transfer assisting particles can also be embedded into the surface of the toner as disclosed in U.S. Pat. Nos. 4,950,573 and 4,900,647. Further, the marking toner having the transfer assisting particles adhered to their surfaces can be made from dispersions of the toner particles and the transfer assisting particles in aqueous or other liquids. Examples of transfer assisting particles include particles of silica, alumina, titanium oxide, barium titanate, magnesium titanate, calcium titanate, strontium titanate, zinc oxide, quartz sand, clay, mica, wollastonite, diatomaceous earth, chromium oxide, cerium, red oxide, antimony trioxide, magnesium oxide, zirconium oxide, barium sulfate, barium carbonate, calcium carbonate, silicon carbide and silicon nitride. A mixture of two or more different types and sizes of tranfer assisting particles can be used. The tranfer assisting particles can be treated before or after adhering to the toner particles. Examples of such treatments are disclosed in U.S. Pat. Nos. 5,412,019; 5,415,936; 5,418,103; 5,419,928 and JP 7,036,211. The more preferred transfer assisting particles include silica, alumina and titanium dioxide. The most preferred transfer assisting particles are finely powdered silica. The amount of the transfer assisting particles added to the toner is from 0.3 to 5.0 percent by weight based on the weight of the toner binder depending on the particle size distribution. Additional examples of toners and methods of producing toners which are useful in this invention are included in EP Application 94110612.2; and U.S. Pat. Nos. 5,378,572; 5,278,018; 5,194,356; 5,192,637; 5,176,979; 5,178,984; 5,021,317; 5,093,220; 4,828,954; 5,362,593; 5,244,764 and 5,364,720. This list of references is not exhaustive. The use of toners with these addenda is further described in the invention of Tombs, May and Gomes; APPARATUS AND METHOD OF TRANSFERRING TONER USING NON-MARKING TONER AND MARKING TONER; U.S. provisional application Ser. No. 60/003,014, filed Aug. 31, 1995 (now U.S. application Ser. No. 08/572,586 filed Dec. 14, 1995), incorporated herein by reference.

The marking and non-marking toners are preferably used in a two component developer consisting of a mixture of toner particles and carrier particles. Carriers can be conductive, non-conductive, magnetic, or non-magnetic. Carriers are particulate and can be glass beads; crystals of inorganic salts, such as, aluminum potassium chloride, ammonium chloride, or sodium nitrate; granules of zirconia, silicon, or silica; particles of hard resin such as poly(methyl methacrylate); and particles of elemental metal or alloy or oxide such as iron, steel, nickel, carborundum, cobalt, oxidized iron and mixtures of such materials. Examples of carriers are disclosed in U.S. Pat. Nos. 3,850,663 and 3,970,571. Especially useful in magnetic brush development procedures are iron particles such as porous iron, particles having oxidized surfaces, steel particles, and other "hard" and "soft" ferromagnetic materials such as gamma ferric oxides or ferrites of barium, strontium, lead, magnesium, or aluminum. Such carriers are disclosed in U.S. Pat. Nos. 4,042,518; 4,478,925; 4,764,445, 5,306,592 and 4,546,060.

Carrier particles can be uncoated or can be coated with a thin layer of a film-forming resin to establish the correct triboelectric relationship and charge level with the toner employed. Examples of suitable resins are the polymers described in U.S. Pat. Nos. 3,547,822; 3,632,512; 3,795,618 and 3,898,170 and Belgian Patent No. 797,132. Other useful resins are fluorocarbons such as polytetrafluoroethylene, poly(vinylidene fluoride), mixtures of these, and copolymers of vinylidene fluoride and tetrafluoroethylene. See for example, U.S. Pat. Nos. 4,545,060; 4,478,925; 4,076,857; and 3,970,571; and 4,726,994. Polymeric fluorocarbon coatings can aid the developer to meet the electrostatic force requirements for transfer by shifting the carrier particles to a position in the triboelectric series different from that of the uncoated carrier core material to adjust the degree of triboelectric charging of both the carrier and toner particles. The polymeric fluorocarbon coatings can also reduce the frictional characteristics of the carrier particles in order to improve developer flow properties; reduce the surface hardness of the carrier particles to reduce carrier particle breakage and abrasion on the photoconductor and other components; reduce the tendency of toner particles or other materials to undesirably permanently adhere to carrier particles; and alter electrical resistance of the carrier particles. Currently preferred is a mixture of poly(vinlyidene fluoride) and poly(methyl methacrylate) as described for example in U.S. Pat. Nos. 4,590,140; 4,209,550; 4,297,427 and 4,937,166.

The carrier can be strontium ferrite coated with fluorocarbon on a 0.5 percent weight/weight basis, and treated with an aqueous solution of 4 weight percent KOH and 4 weight percent of a 2 parts by weight to 1 parts by weight mixture of $Na_2S_2O_8$ and $Na_2S_2O_5$ as disclosed in U.S. patent application Ser. No. 08/127,382, filed Sep. 24, 1993, now U.S. Pat. No. 5,411,832 by William E. Yoerger, which is incorporated herein by reference. The fluorocarbon carrier is also referred to as "modified Kynar®". In a preferred embodiment, the carrier is sponge iron, which is sieved, oxidized and coated with fluorocarbon on a 0.2 weight percent basis.

In a particular embodiment, the developer contains from about 1 to about 20 percent by weight of toner and from about 80 to about 99 percent by weight of carrier particles. Usually, carrier particles are larger than toner particles. Conventional carrier particles have a particle size of from about 5 to about 1200 micrometers and are generally from 20 to 200 micrometers.

The developer can be made by simply mixing the described toner composition and the carrier in a suitable mixing device. The components are mixed until the developer achieves a maximum charge. Useful mixing devices include roll mills and other high energy mixing devices.

It is preferred that the polarity of the charge on the marking toners and the non-marking toners is the same. In the currently preferred process, the marking and the non-marking toners are both positively charged. Further, the currently preferred process uses developer consisting of toner particles and magnetic carrier particles.

The polymer binder used in the invention can be melt processed in a two roll mill or extruder. This procedure can include melt blending of other materials with the polymer, such as toner addenda and colorants. A preformed mechanical blend of particulate polymer particles, pigments and other toner additives can be prepared and then roll milled or extruded. The roll milling, extrusion, or other melt processing is performed at a temperature sufficient to achieve a uniformly blended composition. The resulting material, referred to as a "melt product" or "melt slab" is then cooled. For a polymer having a $T_g$ in the range of about 50° C. to about 120° C., or a $T_m$ in the range of about 65° C. to about 200° C., a melt blending temperature in the range of about 90° C. to about 240° C. is suitable using a roll mill or extruder. Melt blending times, that is, the exposure period for melt blending at elevated temperature, are in the range of about 1 to about 60 minutes.

The melt product is cooled and then pulverized to a volume average particle size of from about 5 to 20 micrometers. It is generally preferred to first grind the melt product prior to a specific pulverizing operation. The grinding can be carried out by any convenient procedure. For example, the solid composition can be crushed and then ground using, for example, a fluid energy or jet mill, such as described in U.S. Pat. No. 4,089,472, and can then be classified in one or more steps. The size of the particles is then further reduced by use of a high shear pulverizing device such as a fluid energy mill.

In place of melt blending or the like, the polymer can be dissolved in a solvent in which the charge control agent and other additives are also dissolved or are dispersed. The resulting solution can be spray dried to produce particulate toner powders. Limited coalescence polymer suspension procedures as disclosed in U.S. Pat. No. 4,833,060, incorporated herein by reference, are particularly useful for producing small sized, uniform toner particles. In that process, binder polymer is dissolved in a water immiscible organic solvent along with charge control agent and pigment if needed and then a water suspension of small droplets of the binder solution are dispersed in water with a stabilizer such as silica. The water immiscible organic solvent is then removed so as to produce a suspension of monodisperse spherical particles of the binder. The water is then removed and the toner composition recovered. The '060 patent discloses the use of a promoter and a silica stabilizer during the process. The silica can be removed by a KOH or HF wash. A polymeric latex can be used as a stabilizer and this is described in U.S. Pat. No. 4,965,131, incorporated herein by reference. For the "latex" stabilized method, the process of Example 4 of U.S. Pat. No. 5,049,469, incorporated herein by reference, can be followed to manufacture the preferred toner compositions.

Using the limited coalescence polymer suspension procedure, the following high pigment marking toners useful in the method of this invention were produced. The charge-control agents are listed in Table I. The high pigment toner compositions are in Table 2. The charge-control agents were made as disclosed in the cited patents listed in Table 1.

Styrene-butyl acrylate copolymer was obtained from Hercules-Sanyo Incorporated under the trade name Piccotoner 1221 and 1218. Styrene-butyl acrylate-iso butyl methacrylate copolymer (40/10/50) was made according to the disclosure in U.S. Pat. No. 4,912,009. Low Molecular Weight Polystyrene was obtained from Hexatec Polymer Company under the trade name H-46™. Dimethyl terephtalate based polyester was made according to the disclosure in U.S. Pat. No. 4,812,377. The pigments were obtained from Cabot Corporation, Columbian Chemical Company, Hoechst Selanese Corporation, and BASF Corporation.

TABLE 1

Charge Control Agents

| Ex. | Description | U.S. Pat. Nos. |
|---|---|---|
| CCA-3 | Tetradecyl pyridinium tetraphenyl borate | similar to 5,196,538 & 5,196,539 |
| CCA-1 | dodecylbenzyl dimethyl ammonium 3-nitrobenzene sulfonate | 4,834,920 4,840,864 |
| CCA-4 | 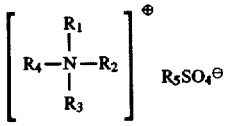 | 4,683,188 4,780,553 |
| CCA-2 | 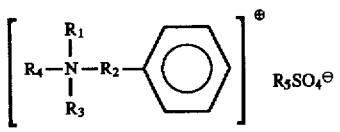 | 4,654,175 4,826,749 4,931,588 |
| CCA-5 | o-benzoic sulfimide | 5,358,818 |

TABLE 2

High Pigment Marking Toners

| Binder | Pigment | Charge Agent |
|---|---|---|
| Styrene-Butyl Acrylate Copolymer | 16% Black Pearls 430 | 0.4 pph CCA-1 |
| Styrene-Butyl Acrylate Copolymer | 20% Black Pearls 430 | 0.4 pph CCA-1 |
| Styrene-Butyl Acrylate Copolymer | 24% Black Pearls 430 | 0.4 pph CCA-1 |
| Styrene-Butyl Acrylate-iso Butyl Methacrylate Copolymer | 20% Black Pearls 430 | 0.4 pph CCA-1 |
| Low Molecular Weight Polystyrene | 20% Black Pearls 430 | 0.4 pph CCA-1 |
| Dimethyl terephtalate based polyester | 20% Black Pearls 430 | 0.4 pph CCA-1 |
| Styrene-Butyl Acrylate Copolymer | 16% Black Pearls 430 & 4% Monolite Blue | 0.4 pph CCA-1 |
| Styrene-Butyl Acrylate Copolymer | 16% Black Pearls 430 & 4% Peliogen Blue | 0.4 pph CCA-1 |
| Styrene-Butyl Acrylate Copolymer | 20% Raven 970 | 0.5 pph CCA-5 |
| Styrene-Butyl Acrylate Copolymer | 20% Sterling R | 0.5 pph CCA-2 |
| Styrene-Butyl Acrylate Copolymer | 20% Novaperm Yellow | 0.4 pph CCA-3 |
| Styrene-Butyl Acrylate Copolymer | 20% Hostaperm Pink E02 | 0.8 pph CCA-4 |
| Styrene-Butyl Acrylate Copolymer | 20% Bridged Al-Phtalocyanine | 0.4 pph CCA-4 |
| Styrene-Butyl Acrylate Copolymer | 30% Bridged Al-Phtalocyanine | 0.4 pph CCA-4 |
| Styrene-Butyl Acrylate Copolymer | 30% Black Pearls 430 | 0.4 pph CCA-4 |
| Styrene-Butyl Acrylate Copolymer | 40% Hostaperm Pink E02 | None |

It will be readily apparent that numerous variations and permutations of these steps or additional other steps can be used in the method of this invention. Also the apparatus of this invention can be constructed with additional features, such as digital scanners and computers as described above to analyze the color information of a final toner image.

The apparatus and method of this invention have been described with reference to particular embodiments. It is understood that various modifications can be made to the preferred apparatus and method of this invention without departing from the spirit and scope of this invention. All the above cited references and patents cited anywhere above are incorporated herein in their entirety.

What is claimed is:

1. A method of forming a desired toner image on a receiver, said method comprising:

forming at least one electrostatic image on at least one imaging member;

toning at least one said electrostatic image with marking toner particles;

transferring said marking toner particles from at least one said imaging member to the surface of an intermediate transfer member in the presence of an electric field which urges said marking toner particles toward said intermediate transfer member; and transferring said marking toner particles from said intermediate transfer member to a receiver in the presence of an electric field which urges said marking toner particles toward said receiver;

wherein, when transferring said marking toner particles to said intermediate transfer member from at least one said imaging member, said surface of said intermediate transfer member contacts non-marking toner particles at least in areas which receive marking toner particles, and wherein said marking toner particles have a volume weighted diameter of 2 to 8 μm and comprise pigment at a concentration of from 10 to 50% by weight of the total toner composition.

2. The method of claim 1, wherein when transferring said marking toner particles to said intermediate transfer member, said surface of said intermediate transfer member contacts non-marking toner particles everywhere in one or more predetermined areas and only in areas which receive marking toner particles outside of one or more said predetermined areas.

3. The method of claim 1, wherein when transferring said marking toner particles to said intermediate transfer member, said surface of said intermediate transfer member contacts non-marking toner particles everywhere within an image frame of said intermediate transfer member.

4. The method of claim 1, wherein said marking toner particles comprise pigment at a concentration of from 20 to 40% by weight of the total toner composition.

5. The method of claim 1, wherein said intermediate transfer member comprises a layer having an electrical resistivity greater than $10^6$ Ohm-cm.

6. The method of claim 1, wherein said intermediate transfer member comprises a blanket having a Young's modulus of $10^8$ Newtons/$m^2$ or less.

7. The method of claim 6, wherein said intermediate transfer member further comprises an overcoat on said blanket, said overcoat having a Young's modulus greater than $10^8$ Newtons/$m^2$ and has a thickness of 50 μm or less.

8. The method of claim 1, wherein said marking toner particles have a mean volume weighted diameter from 3 to 6 μm.

9. The method of claim 1, wherein said non-marking toner particles have a mean volume weighted diameter from 2 to 10 μm.

10. The method of claim 1, wherein the size of the marking toner particles and the non-marking toner particles are approximately the same.

11. The method of claim 1, wherein said marking toner particles include transfer assisting addenda.

12. The method of claim 1, wherein said steps of forming, toning and transferring said marking toner particles from at least one said imaging member are further characterized by the following steps:

forming and toning at least two electrostatic images on the same frame of an imaging member with marking toners of at least two different colors;

simultaneously transferring said marking toners of at least two different colors from said imaging member to the surface of an intermediate transfer member in the presence of an electric field which urges said marking toner particles toward said intermediate transfer member.

13. The method of claim 1, wherein said steps of forming, toning and transferring said marking toner particles from one or more said imaging member are further characterized as comprising the following steps:

forming on an imaging member an electrostatic image corresponding to one color in said desired toner image;

toning by applying the corresponding color marking toner particles to said electrostatic image to form an individual color toner image;

transferring said individual color toner image to the surface of an intermediate transfer member in the presence of an electric field which urges said individual toner images toward said intermediate transfer member;

and repeating said forming, toning and transferring steps for each color separation so that said individual color toner images are in registration on said surface of said intermediate transfer member.

14. The method of claim 1, further comprising after said step of toning at least one said electrostatic image with marking toner particles, the additional step of applying non-marking toner particles at least over said marking toner particles on at least one said electrostatic image.

15. The method according to claim 1, wherein the amount of said non-marking toner particles contacting said intermediate transfer member is at least a monolayer of non-marking toner particles.

16. The method according to claim 1, wherein the amount of said non-marking toner particles contacting said intermediate transfer member is from a monolayer to four layers of non-marking toner particles.

17. The method of claim 1 further comprising prior to said forming step the additional steps of:

inputting image information of a desired toner image into a digital computer; and analyzing said image information to establish bit maps for each color separation in a desired toner image and to establish a bit-map for the application of non-marking toenr to the intermediate transfer member;

and wherein said forming step is further characterized in that said bit maps are used to control where the non-marking toner is applied.

18. The method of claim 1 whereby the amount of said non-marking toner particles contacting said intermediate transfer member levels the stack-heights of said non-marking toner particles and marking toner particles on said intermediate transfer member.

19. The method of claim 1, further comprising, after the step of transferring said marking toner particles from said intermediate transfer member, the following steps:

applying non-marking toner particles to said receiver over said marking toner particles; and fusing said marking toner particles and said non-marking toner particles to said receiver.

20. The method of claim 1, further comprising before said forming step, the additional step of applying non-marking toner particles to at least one said imaging member.

21. The method of claim 1, further comprising, before the step of transferring said marking toner particles from said intermediate transfer member, the additional step of applying non-marking toner particles to said receiver.

* * * * *